US009677240B2

(12) United States Patent
Paske

(10) Patent No.: US 9,677,240 B2
(45) Date of Patent: Jun. 13, 2017

(54) SINGLE DIRECTION VIBRATORY PLATE

(75) Inventor: Benjamin J. Paske, Slinger, WI (US)

(73) Assignee: M-B-W Inc., Slinger, WI (US)

( * ) Notice: Subject to any disclaimer, the term of this patent is extended or adjusted under 35 U.S.C. 154(b) by 904 days.

(21) Appl. No.: 13/603,675

(22) Filed: Sep. 5, 2012

(65) Prior Publication Data

US 2014/0064858 A1 Mar. 6, 2014

(51) Int. Cl.
*E02D 3/02* (2006.01)
*E02D 3/046* (2006.01)

(52) U.S. Cl.
CPC ..... *E02D 3/046* (2013.01)

(58) Field of Classification Search
CPC ..... E02D 3/046; E02D 3/123; E02D 27/26; E02D 3/074; E02D 3/068
USPC ..... 404/2, 114, 117, 133.05, 133.1, 133.2; 405/271
See application file for complete search history.

(56) References Cited

U.S. PATENT DOCUMENTS 3,603,224 A * 9/1971 Dresher ..... E02D 3/074 173/162.1
3,782,845 A * 1/1974 Briggs ..... E02D 3/046 404/133.1
3,899,263 A * 8/1975 Briggs ..... E02D 3/046 404/133.1
3,972,637 A 8/1976 Sutherland
4,067,244 A 1/1978 Baumers
4,113,403 A * 9/1978 Tertinek ..... E02D 3/074 404/113
4,643,611 A * 2/1987 Pilachowski ..... E02D 3/074 404/133.1
5,387,052 A 2/1995 Artzberger
5,439,314 A 8/1995 Wadensten
5,857,803 A 1/1999 Davis et al.
5,934,825 A * 8/1999 Waldenberger ..... E01C 19/38 404/133.1
6,296,467 B1 10/2001 Rouillard
6,394,697 B1 5/2002 De Boer
6,435,767 B1 * 8/2002 Steffen ..... E01C 19/38 404/133.05
6,588,977 B1 7/2003 Stayner
6,988,851 B2 1/2006 Sina
7,165,469 B2 1/2007 Niemi et al.
(Continued)

OTHER PUBLICATIONS

MBW Inc. Compaction & Concrete Construction Equipment; Vibratory Plate Amplitude Calculator; http://www.mbw.com/products/plate/ampcala.aspx.

(Continued)

*Primary Examiner* — Benjamin Fiorello
*Assistant Examiner* — Edwin Toledo-Duran
(74) *Attorney, Agent, or Firm* — Andrus Intellectual Property Law LLP

(57) ABSTRACT

A vibratory compaction plate utilizes pairs of front and rear shock absorbing mounts, each pair of which is set at a different angle with respect to the horizontal plate to optimize the respective shear and compression capabilities and optimize performance. A front mounted vibratory exciter and a rear mounted engine provide different performance capabilities that are optimized by the mounting angles. A flat sheet metal plate and sheet metal frame permit the angles at which the shock mounts are oriented to be adjusted along laterally extending end lines to fine tune performance.

18 Claims, 6 Drawing Sheets

(56) References Cited

U.S. PATENT DOCUMENTS

| | | | | |
|---|---|---|---|---|
| 2004/0022582 | A1* | 2/2004 | Sick | E01C 19/004 404/133.05 |
| 2009/0035065 | A1* | 2/2009 | Gavins | E02D 3/074 404/114 |
| 2013/0243526 | A1* | 9/2013 | Williamson | F16F 15/02 404/133.1 |

OTHER PUBLICATIONS

MBW Inc. Compaction & Concrete Construction Equipment; Vibratory Plates; http://www.mbw.com/Plates.aspx.

* cited by examiner

SINGLE DIRECTION VIBRATORY PLATE

BACKGROUND

The present invention pertains to vibratory plates of the type used in various construction activities to tamp and compact soil and other loose base materials. A typical vibratory plate construction includes a flat, ground-engaging plate made of steel or other strong and rigid material. The plate is attached to an overlying frame and separated therefrom by elastomer shock mounts, typically two shock mounts near the front edge of the plate and two mounts near the rear edge of the plate. The prior art teaches a variety of orientations for the shock mounts depending on the properties of the elastomer material that are used to optimize vibratory compaction.

The frame carries an engine and the plate carries a rotary vibratory exciter connected to the engine by a drive belt. Vibratory plates may be uni-directional or bi-directional (reversible), but the present invention relates particularly to single direction vibratory plates. The driven exciter imparts vibratory forces to the plate and the underlying surface material being compacted. In a single direction vibratory plate, the exciter is typically mounted toward the front of the plate to maximize the amplitude of the vibratory forces and to facilitate forward movement of the plate. The prior art shows many different arrangements in the positioning of elastomeric shock mounts on vibratory plates, but often with no discussion as to how operation of the shock mounts in shear or compression can be utilized to optimize performance.

SUMMARY

In accordance with the present invention, conventional prior art shock mounts are attached to and positioned between the plate and the frame utilizing a simple construction that permits adjustment or fine tuning of the plate to optimize performance.

In accordance with one embodiment, the plate has an upwardly angled front edge that defines a lower front attachment face for a pair of front shock mounts. The plate also has an upwardly angled rear edge that defines a lower rear attachment face for a pair of rear shock mounts. The frame has a generally flat front edge that is spaced from and parallel to the lower front attachment face of the plate and defines an upper front attachment face for the front shock mounts. The frame also has an upwardly angled rear edge face that is spaced from and parallel to the lower rear attachment face of the plate and defines an upper rear attachment face for a pair of rear shock mounts. The front shock mounts are positioned between the lower front attachment face and the upper front attachment face and attached to extend between those faces. The central axis of each front shock mount extends perpendicular to the lower front attachment face and the upper front attachment face at an angle from the plane of the bottom surface of the plate in the range of about 20° to 40°, and a pair of rear shock mounts that are positioned between the lower rear attachment face and the upper rear attachment face and attached therebetween. A central axis of each rear shock mount extends perpendicular to the lower rear attachment face and the upper rear attachment face at an angle from the plane of the bottom surface of the plate in the range of about 50° to 90°.

In accordance with a presently preferred embodiment of the invention, the lower front edge of the plate is an integral extension of the plate and is joined to the plate along a laterally extending lower front bend line set to selectively position the central axes of the front shock mounts at an angle from the plane of the plate surface in the range of about 20° to 40°, and the upper front edge of the frame is an integral extension of the frame and is joined thereto along an upper front bend line set to position the front edge face of the frame parallel to the lower front face of the plate.

In a similar manner, the lower rear edge of the plate comprises an integral extension of the plate and is connected thereto along a lower rear bend line that is set to selectively position the central axes of the rear shock mounts at an angle in the range of 50° to 90°, and the upper rear face of the frame comprises an integral extension of the frame and is connected thereto along an upper rear bend line that is set to position the rear edge face of the frame parallel to the lower rear face of the plate. Thus, the front and rear bend lines of the plate and the respective front and rear bend lines of the frame permit adjustment of the axes of the shock mounts over a range of angles as indicated.

The elastomer material, preferably natural rubber, of the front shock mounts and the rear shock mounts has a preferred durometer in the range of about 25-45 Shore A on the Shore Hardness Scale. The front shock mounts are positioned to operate primarily in shear and the rear shock mounts are positioned to operate primarily in compression.

The engine is mounted atop the frame near the rear end thereof, and the exciter is mounted near the front end of the plate. The drive belt extends downwardly and forwardly from the engine to the exciter at an angle of about 30° from the horizontal.

The frame preferably comprises a recessed rear planar engine mounting surface and a raised front surface joined to the engine mounting surface by a generally vertical connecting plate. The engine mounting surface extends downwardly and forwardly and terminates in the flat front edge. The flat front edge extends generally perpendicular to the raised surface along a front bend line. The engine mounting surface extends rearwardly from the connecting plate and terminates in said rear edge. The rear edge extends at an acute angle to the engine mounting surface along a rear bend line.

DETAILED DESCRIPTION

Figure 1:
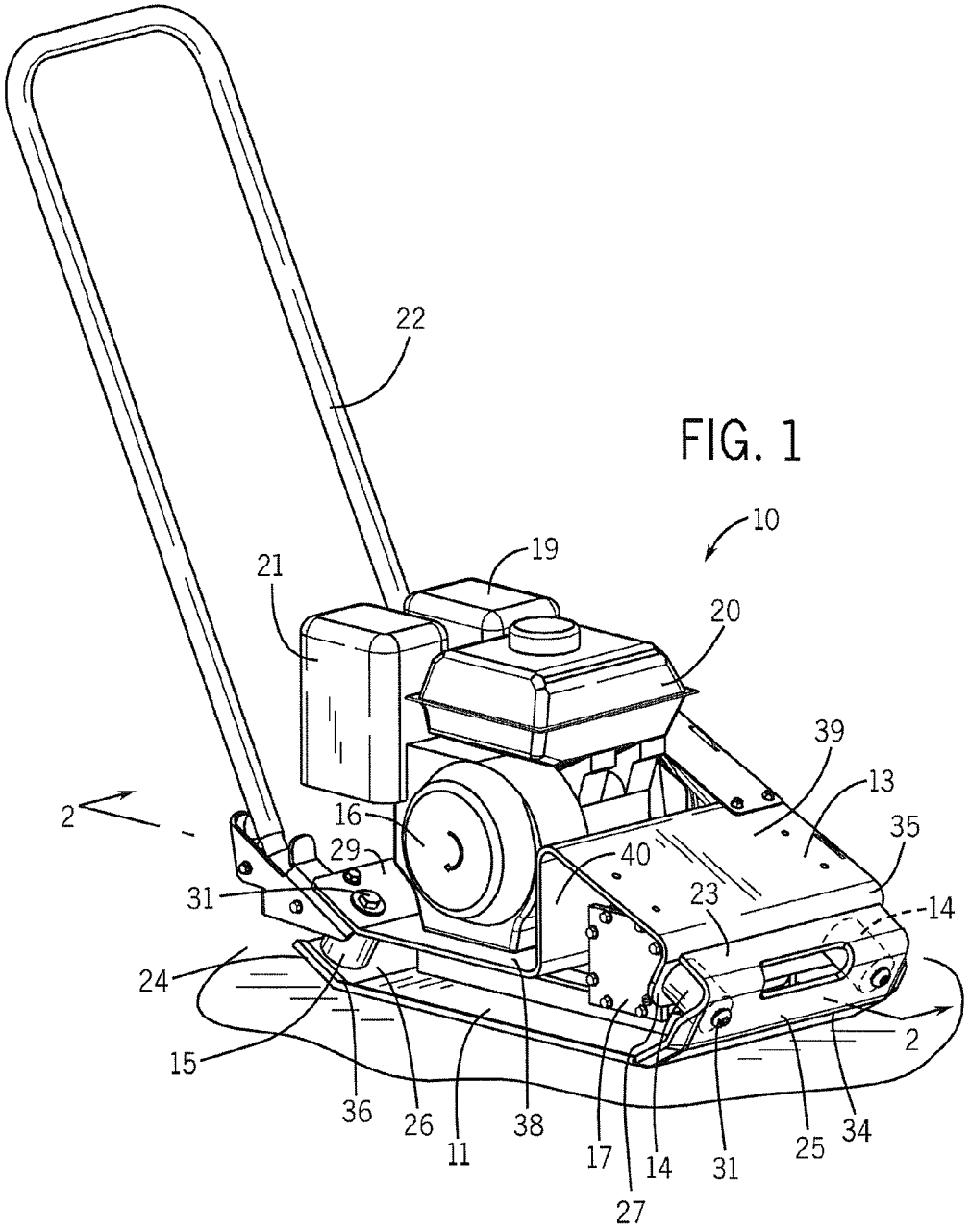
FIG. 1 is a perspective view of the vibratory plate of the present invention.
Figure 2:
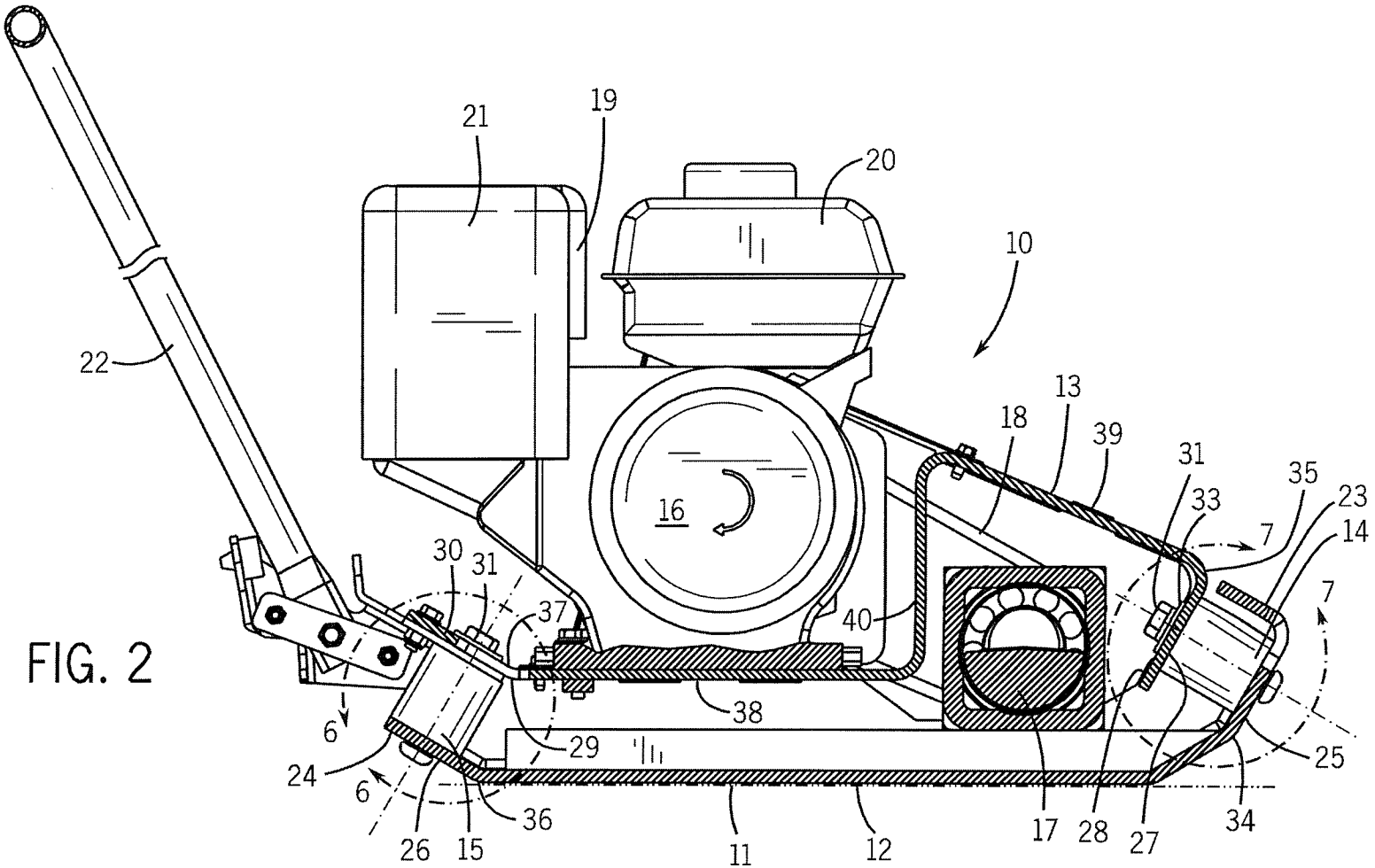
FIG. 2 is vertical sectional view through the vibratory plate of FIG. 1 taken on line 2-2 thereof.
Figure 3:
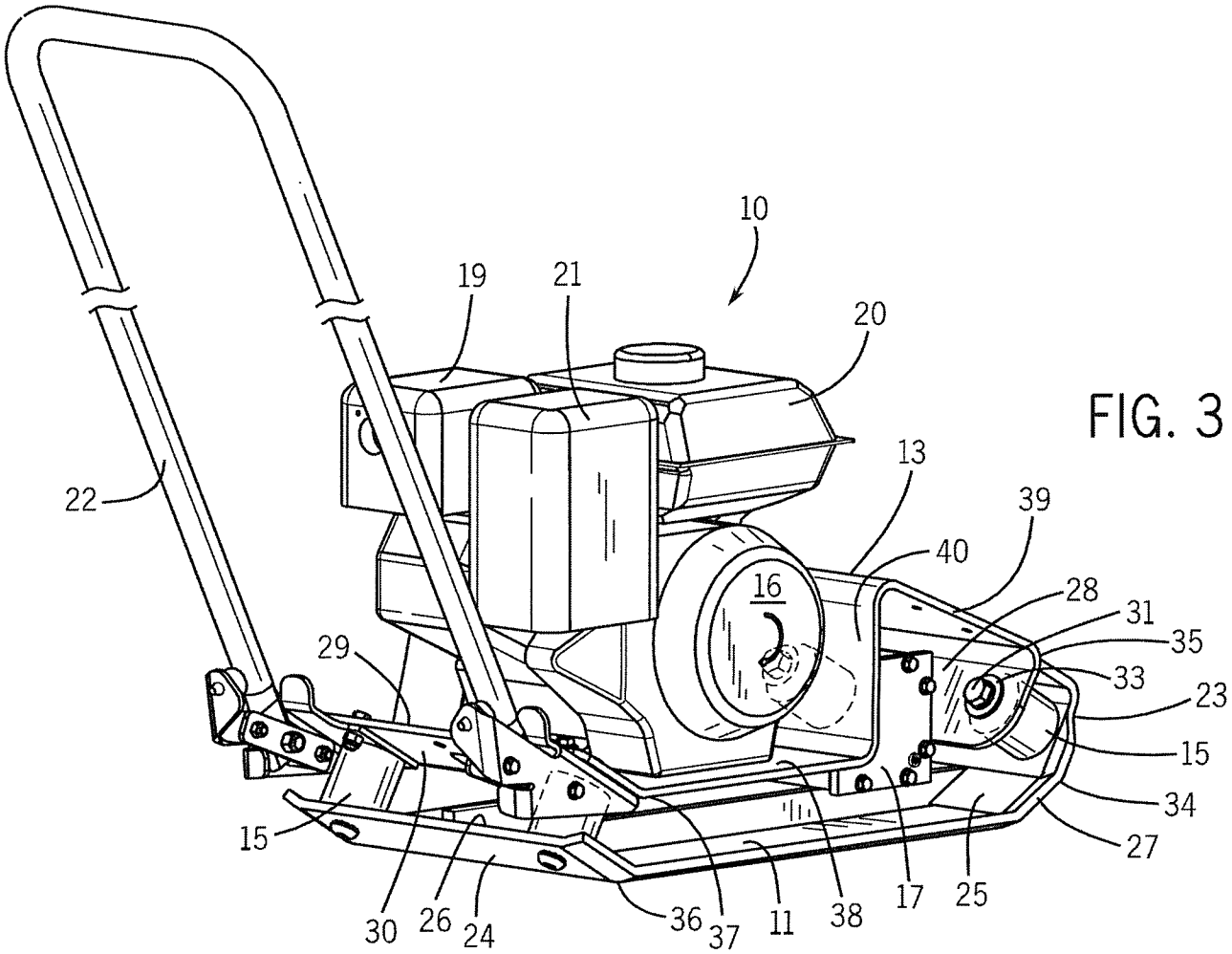
FIG. 3 is a perspective view similar to FIG. 1.
Figure 4:
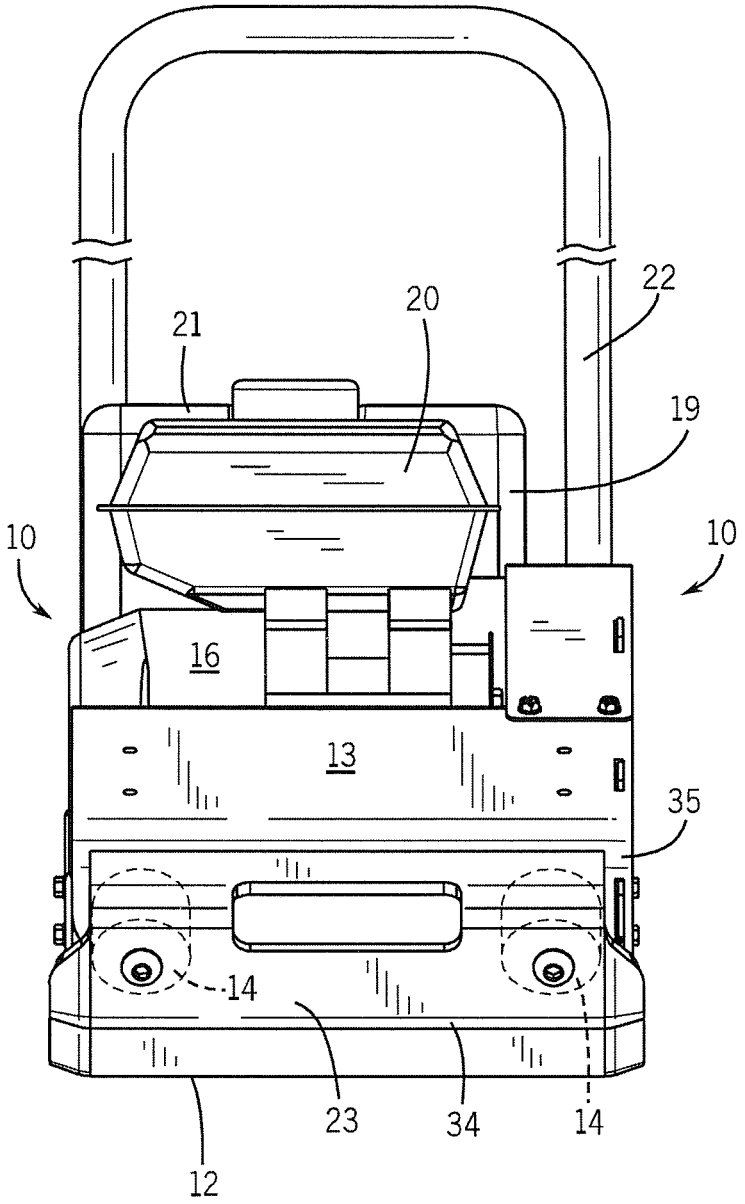
FIG. 4 is a front view of the vibratory plate.
Figure 5:
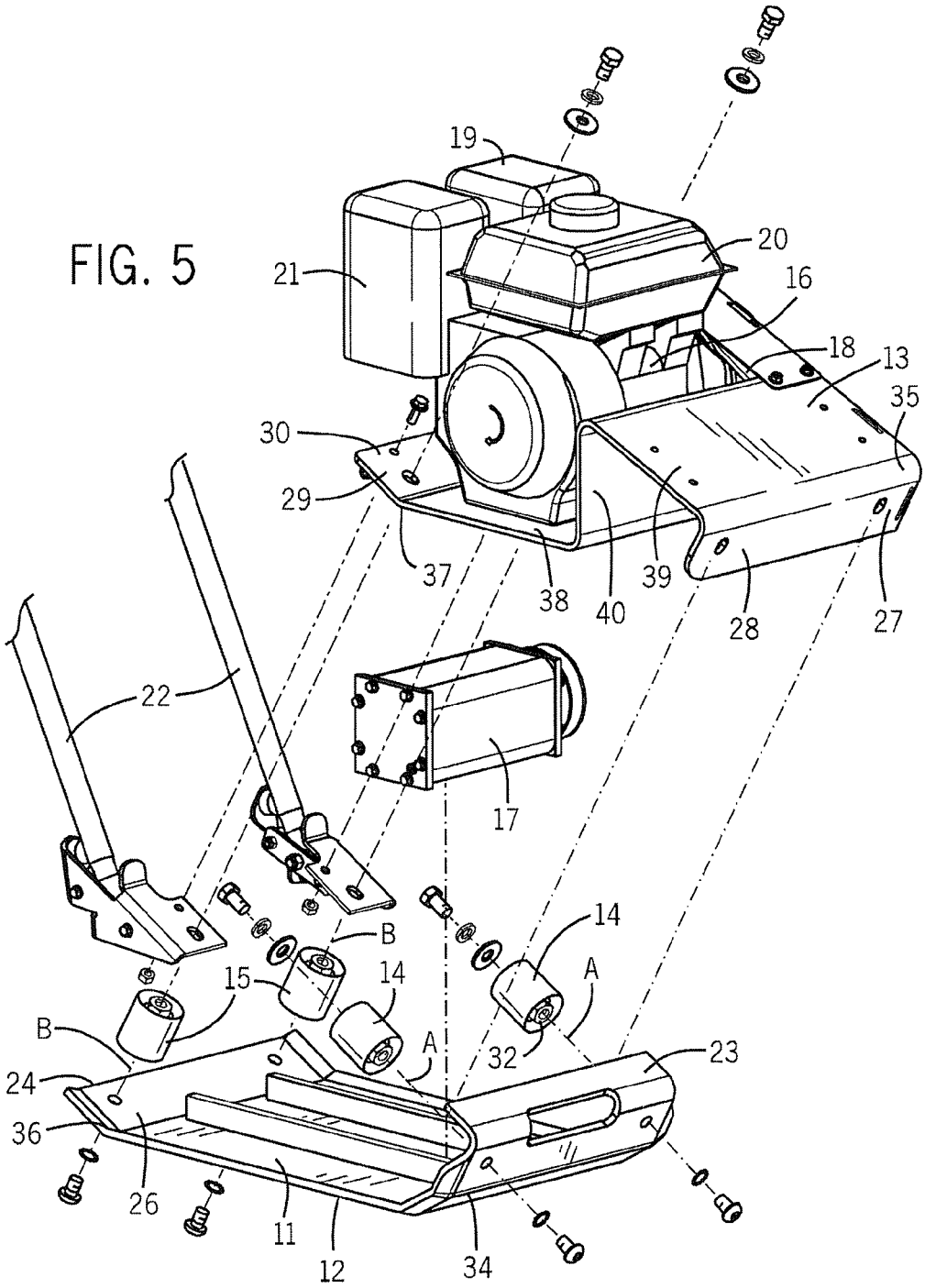
FIG. 5 is an exploded view of the vibratory plate.
Figure 6:
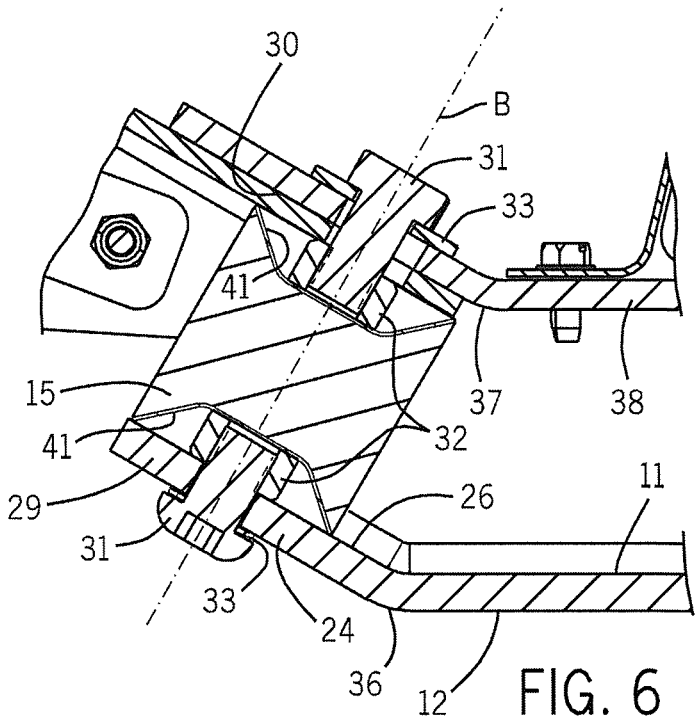
FIG. 6 is an enlarged detail of the rear shock mount in FIG. 2 taken on line 6-6 thereof.
Figure 7:
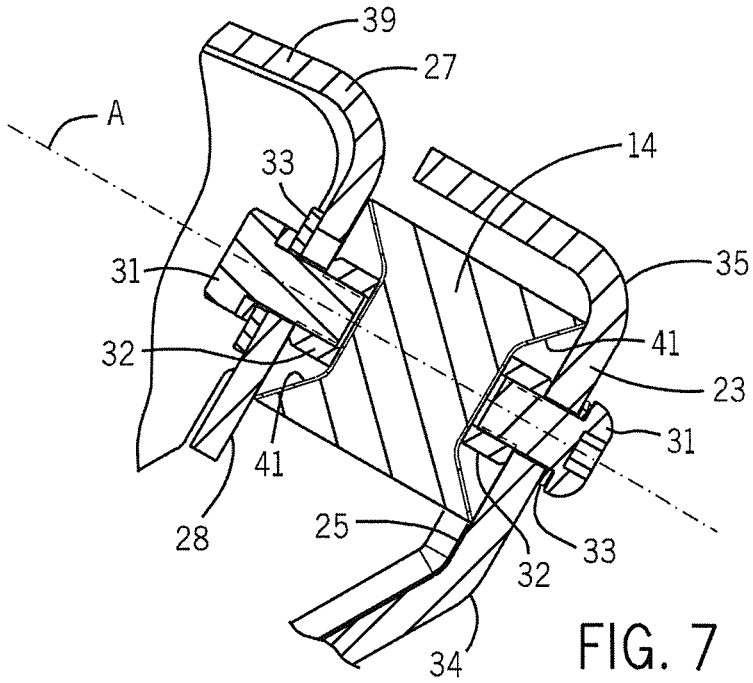
FIG. 7 is an enlarged detail of the front shock mount in FIG. 2 taken on line 7-7 thereof.

Referring initially to FIGS. 1 and 2, a vibratory plate 10 includes, as its main components, a plate 11 having a planar bottom working surface 12, a frame 13 mounted above plate 11 and isolated therefrom by a pair of front shock mounts 14 and a pair of rear shock mounts 15. The frame carries an engine 16 that is operative to drive a vibratory exciter 17 mounted to the forward portion of the frame 14 and driven by a drive belt 18 connecting the engine output shaft and the shaft of the exciter. The engine 16 is mounted toward the rear of the frame 13 where also are located a fuel tank 20, a water tank 21 and related accessories. The conventional U-shaped operator handle 22 is attached by its lower ends to the rear of the frame 13. Thus, the shock mounts 14 and 15 isolate the frame 13 and the handle 22 from the vibratory plate 10.

The plate 11 is formed from a single steel sheet providing the planar bottom surface 12, an upwardly angled front edge 23 and an upwardly angled rear edge 24. The upwardly angled front edge defines a lower front attachment face 25 for the front shock mounts 14 and the rear edge 24 defines a lower rear attachment face 26 for the rear shock mounts 15.

The frame 13 is formed from a single steel sheet having a number of laterally extending bends, the functions of which will be described below. The frame includes a generally flat front edge 27 that, in the mounted position, is parallel to the front edge 23 and lower front attachment face 25 of the plate 11 and defines an upper front attachment face 28 for the front shock mounts 14. The frame 13 also includes an upwardly angled rear edge 29 that is spaced from and parallel to the lower rear attachment face 26 of the plate 11 and defines an upper rear attachment face for the rear shock mounts 15.

The shock mounts 14 and 15 may be identical in construction and in the flexible elastomer material of which they are made. The elastomer material is preferably natural rubber having a durometer in the range of about 25-45 Shore A on the Shore Hardness Scale and, preferably, a durometer of about 30 Shore A on the Shore Hardness Scale. The front shock mounts 14 are mounted between the lower front attachment face 25 of the plate and the upper front attachment face 28 of the frame 13. The rear shock mounts 15 are attached between the lower rear attachment face 26 of the plate and the upper front rear attachment face 30 of the frame 13. Each shock mount 14 or 15 is preferably of a cylindrical shape. Each end of shock mount 14 or 15 includes a rigid frustoconical end plate 41 that is bonded to the elastomer material. Prior to bonding, a nut 32 is welded to the end plate 41 to provide attachment for the shock mount to one of the attachment faces 25, 26, 28 and 30 using a bolt 31 and washer 33. The front shock mounts 14 are positioned between the lower front attachment face 25 and the upper front attachment face 28 at an angle from the plane of the bottom surface 12 of the plate in the range of about 20° to about 40°. The rear shock mounts 15 are positioned between the lower rear attachment face 26 of the plate 11 and the upper rear attachment face 30 of the frame at an angle from the plane of the bottom surface 12 of the plate in the range of about 50° to about 90°. Preferably, the mounting angle of the front shock mounts 14 is about 30° and the mounting angle of the rear shock mounts 15 is about 60°.

The angles at which the shock mounts 14 and 15 are mounted with respect to the horizontal has a significant effect on the manner in which vibrations from the plate-mounted exciter 17 are transmitted to the plate 11. This results in a greater amplitude of vibration toward the front of the plate which beneficially affects both compaction efficiency and the uni-directional movement of the plate. To provide these benefits in the vibratory plate of the present invention, the angles of the shock mounts 14 and 15 are carefully controlled to optimize compaction and, at the same time, minimize the transmission of vibrations to the frame and the operator. As indicated, the front shock mounts 14 are positioned so their axes A preferably extend at a shallow angle of about 30° to the horizontal. Rear shock mounts 15, on the other hand, are mounted with their axes B at a substantially greater angle, preferably 60° to the horizontal.

However, the simple construction of the plate 11 permits fine tuning of the positions of the shock mounts 14 and 15 to further optimize performance. Because the front shock mounts 14 must handle the high amplitude movement from the exciter and, in addition, the horizontal load created by drive belt tension, the front shock mounts are positioned at an angle closer to the horizontal than to the vertical, causing the shock mounts to work primarily in shear. This permits greater movement in the shock mounts to accommodate base plate movement, as well as compression of the mount to accommodate belt tension.

The rear shock mounts 15, on the other hand, are positioned to support the vertical load from the engine and are thus positioned at an angle closer to the vertical than to the horizontal. This permits the shock mounts to work primarily in compression, allowing the mount to provide support without causing the shock mount material to be overstressed.

In order to further enhance performance of the vibratory plate, the angular positioning of the shock mounts may be adjusted slightly within the ranges set forth above. Changing these angles may be facilitated by positioning the integral front edge 23 of the plate 11 to selectively bend the front edge of the plate on a lateral lower front bend line 34 and, correspondingly, the integral front edge 27 of the frame 13 can be bent slightly along the upper front bend line 35 to reset the position of the upper front edge 27 of the frame parallel to the lower front edge 23 of the plate. In a similar manner, the integral lower rear edge 24 of the plate is joined to the plate along a lower rear bend line 36 to permit selective positioning of the rear edge 24. An upper rear bend line 37 is set to selectively position the upper rear edge 29 of the frame parallel to the lower rear edge 24 of the plate. This type of angular adjustment of the plate and the frame is relatively easy with the construction of the plate of the present invention.

The engine 16 is mounted on the frame 13 near the rear end of the frame. As is previously mentioned, the exciter 17 is mounted near the front end of the plate such that the drive belt 18 extends downwardly and forwardly from the engine to the exciter at an angle preferably of about 30°, but could be adjusted anywhere in the range of about 20° to 40°. The frame 13 includes a recessed rear planar engine mounting surface 38 and a raised front surface 39 that is joined to the engine mounting surface by a generally vertical connecting surface 40. The raised front surface 39 extends downwardly and forwardly to terminate in the flat front edge 27 of the frame 13. The flat front edge 27 extends generally perpendicular to the raised front surface 39 along the front bend line 35. The engine mounting surface 38 extends rearwardly from the connecting surface 40 and terminates in the rear edge 29. The rear edge extends at the preferred acute angle of about 30° to the engine mounting surface 38 along the upper rear bend line 37.

To summarize briefly, the front shock mounts 14 are angled to operate primarily in shear to accommodate the higher amplitude vibrations at the front of the plate. The rear shock mounts 15 are positioned to operate primarily in compression to provide stability to the frame and engine and to isolate the amplitude of the vibrations at the rear of the plate which are already lower as a result of the forward mounting of the exciter. Angular adjustment may be limited to only the front of the plate or only to the rear of the plate, or to both, as described above.

What is claimed is:

1. A compaction apparatus comprising:

a vibratory plate of the type used in surface compaction, the vibratory plate supported on a frame with elastomer shock mounts, the frame carrying an engine, a drive belt operatively connecting the engine and a vibratory exciter mounted on the vibratory plate, and a handle attached to the frame;

the vibratory plate having a planar bottom surface and an upwardly angled front edge defining a lower front attachment face for front shock mounts, and an upwardly angled rear edge defining a lower rear attachment face for rear shock mounts;

the frame having a generally flat front edge spaced from and parallel to the lower front attachment face of the vibratory plate and defining an upper front attachment face for the front shock mounts, and an upwardly angled rear edge spaced inwardly from and parallel to the lower rear attachment face of the vibratory plate and defining an upper rear attachment face for rear shock mounts;

a pair of front shock mounts positioned between the lower front attachment face and the upper front attachment face and attached thereto, a central axis of each front shock mount extending perpendicular to the lower front attachment face and the upper front attachment face; and a pair of rear shock mounts positioned between the lower rear attachment face and upper rear attachment face and attached thereto, a central axis of each rear shock mount extending perpendicular to the lower rear attachment face and the upper rear attachment face.

2. The compaction apparatus as set forth in claim 1, wherein the lower front edge of the vibratory plate is an integral extension of the vibratory plate and is joined to the vibratory plate along a laterally extending lower front bend line set to selectively position the central axes of the front shock mounts at an angle in a range of 20° to 40°, and the upper front edge of the frame is an integral extension of the frame and is joined to the frame along an upper front bend line set to position the front edge of the frame parallel to the lower front edge of the vibratory plate.

3. The compaction apparatus as set forth in claim 1, wherein the lower rear edge of the vibratory plate is an integral extension of the vibratory plate and is connected to the vibratory plate along a lower rear bend line set to selectively position the central axes of the rear shock mounts at an angle in a range of 50° to 90°, and the upper rear edge of the frame is an integral extension of the frame and is joined to the frame along an upper rear bend line set to position the rear edge of the frame parallel to the lower rear edge of the vibratory plate.

4. The compaction apparatus as set forth in claim 1, wherein the front shock mounts have a durometer in the range of about 25 to 45 Shore A.

5. The compaction apparatus as set forth in claim 1, wherein the rear shock mounts have a durometer in the range of about 25 to 45 Shore A.

6. The compaction apparatus as set forth in claim 1, wherein the front shock mounts are positioned to operate primarily in shear.

7. The compaction apparatus as set forth in claim 1, wherein the rear shock mounts are positioned to operate primarily in compression.

8. The compaction apparatus as set forth in claim 1, wherein the engine is mounted atop the frame near the rear end thereof, and the exciter is mounted near the front end of the vibratory plate; and wherein the drive belt extends downwardly and forwardly from the engine to the exciter at an angle of about 30°.

9. The compaction apparatus as set forth in claim 1, wherein the upwardly angled front edge of the vibratory plate is positioned forward of the upwardly angled rear edge of the vibratory plate relative to directional movement of the vibratory plate toward the upwardly angled front edge of the vibratory plate from the upwardly angled rear edge of the vibratory plate.

10. The compaction apparatus as set forth in claim 9, wherein the front edge of the frame is spaced inwardly from and parallel to the lower front attachment face of the vibratory plate.

11. A compaction apparatus comprising:

a vibratory plate of the type used in surface compaction, the vibratory plate supported on a frame with elastomer shock mounts, the frame carrying an engine, a drive belt operatively connecting the engine and a vibratory exciter mounted on the vibratory plate, and a handle attached to the frame;

the vibratory plate having a planar bottom surface and an upwardly angled front edge defining a lower front attachment face for front shock mounts, and an upwardly angled rear edge defining a lower rear attachment face for rear shock mounts, wherein the upwardly angled front edge of the vibratory plate is positioned forward of the upwardly angled rear edge of the vibratory plate relative to directional movement of the vibratory plate toward the upwardly angled front edge of the vibratory plate from the upwardly angled rear edge of the vibratory plate;

the frame having a generally flat front edge spaced from and parallel to the lower front attachment face of the vibratory plate and defining an upper front attachment face for the front shock mounts and an upwardly angled rear edge spaced inwardly from and parallel to the lower rear attachment face of the vibratory plate and defining an upper rear attachment face for rear shock mounts;

a pair of front shock mounts positioned between the lower front attachment face and the upper front attachment face and attached thereto, a central axis of each front shock mount extending perpendicular to the lower front attachment face and the upper front attachment face such as to cause the front shock mounts to operate primarily in shear; and a pair of rear shock mounts positioned between the lower rear attachment face and upper rear attachment face and attached thereto, a central axis of each rear shock mount extending perpendicular to the lower rear attachment face and the upper rear attachment face such as to cause the rear shock mounts to operate primarily in compression.

12. The compaction apparatus as set forth in claim 11, wherein the frame comprises:

a recessed rear planar engine mounting surface and a raised front surface joined to the engine mounting surface by a generally vertical connecting surface;

the raised front surface extending downwardly and forwardly and terminating in said flat front edge;

said flat front edge extending generally perpendicular to the raised front surface along a front bend line;

the engine mounting surface extending rearwardly from the connecting surface and terminating in said rear edge; and, said rear edge extending at an acute angle to the engine mounting surface along a rear bend line.

13. The compaction apparatus as set forth in claim 11, wherein the front edge of the frame is spaced inwardly from and parallel to the lower front attachment face of the vibratory plate.

14. A compaction apparatus comprising:

a vibratory plate of the type used in surface compaction, the vibratory plate supported on a frame with elastomer shock mounts, the frame carrying an engine, a drive belt operatively connecting the engine and a vibratory exciter mounted on the vibratory plate, and a handle attached to the frame;

the vibratory plate having a planar bottom surface and an upwardly angled front edge defining a lower front attachment face for front shock mounts, and an upwardly angled rear edge defining a lower rear attachment face for rear shock mounts;

the frame having a generally flat downwardly angled front edge spaced from and parallel to the lower front attachment face of the vibratory plate and defining an upper front attachment face for the front shock mounts, and an upwardly angled rear edge spaced inwardly from and parallel to the lower rear attachment face of the vibratory plate and defining an upper rear attachment face for rear shock mounts;

a pair of front shock mounts positioned between the lower front attachment face and the upper front attachment face and attached thereto, a central axis of each front shock mount extending perpendicular to the lower front attachment face and the upper front attachment face;

a pair of rear shock mounts positioned between the lower rear attachment face and upper rear attachment face and attached thereto, a central axis of each rear shock mount extending perpendicular to the lower rear attachment face and the upper rear attachment face;

wherein the lower front edge of the vibratory plate is an integral extension of the vibratory plate and is joined to the vibratory plate along a laterally extending lower front bend line, and the upper front edge of the frame is an integral extension of the frame and is joined to the frame along an upper front bend line and wherein the upper front edge of the frame is parallel to the lower front edge of the vibratory plate; and, wherein the lower rear edge of the vibratory plate is an integral extension of the vibratory plate and is joined to the vibratory plate along a lower rear bend line, and the upper rear edge of the frame is an integral extension of the frame and is joined to the frame along an upper rear bend line and wherein the upper rear edge of the frame is parallel to the lower rear edge of the vibratory plate.

15. The compaction apparatus as set forth in claim 14, wherein the central axis of each front shock mount extending perpendicular to the lower front attachment face and the upper front attachment face is at a first acute angle from the plane of the horizontal bottom surface of the vibratory plate in the range of about 20° to 40°.

16. The compaction apparatus as set forth in claim 14, wherein the central axis of each rear shock mount extending perpendicular to the lower rear attachment face and the upper rear attachment face is at a second acute angle from the plane of the horizontal bottom surface in the range of about 50° to 90°.

17. The compaction apparatus as set forth in claim 14, wherein the upwardly angled front edge of the vibratory plate is positioned forward of the upwardly angled rear edge of the vibratory plate relative to directional movement of the vibratory plate toward the upwardly angled front edge of the vibratory plate from the upwardly angled rear edge of the vibratory plate.

18. The compaction apparatus as set forth in claim 17, wherein the front edge of the frame is spaced inwardly from and parallel to the lower front attachment face of the vibratory plate.

* * * * *